US005908329A

United States Patent [19]

Chen et al.

[11] Patent Number: 5,908,329

[45] Date of Patent: Jun. 1, 1999

[54] ELECTRICAL CONNECTOR HAVING POSITIONING POSTS

[75] Inventors: Caesar Chen, Fountain Valley, Calif.; Yu-San Hsiao; Li-Ming Po, both of Tu-Chen, Taiwan

[73] Assignee: Hon Hai Precision Ind. Co., Ltd., Taipei Hsien, Taiwan

[21] Appl. No.: 08/902,496

[22] Filed: Jul. 27, 1997

[30] Foreign Application Priority Data

Aug. 31, 1996 [TW] Taiwan ..... 85213593

[51] Int. Cl.[6] ..... H01R 13/60

[52] U.S. Cl. ..... 439/567

[58] Field of Search ..... 439/567, 571, 439/572; 411/509

[56] References Cited

U.S. PATENT DOCUMENTS 3,678,797 7/1972 Seckerson ..... 439/411

5,322,452 6/1994 Mosquera ..... 439/567

5,697,812 12/1997 Sampson et al. ..... 439/567

*Primary Examiner*—Gary Paumen

*Assistant Examiner*—Antoine Ngandjui

[57] ABSTRACT

An electrical connector having positioning posts is disclosed. The electrical connector comprises a first and a second positioning posts formed on both longitudinal ends of a front surface of an insulating housing for inserting into a pair of holes of a printed circuit board. Each of the first and second positioning posts defines a respective longitudinal direction, and includes a pair of positioning members on both longitudinal ends, a stop bar between the pair of positioning members, and an open slot between each of the positioning members and the stop bar. The width of the positioning post defined by both sides of the stop bar is shorter than the length of the positioning post defined between respective longitudinal outer surfaces of the positioning members.

10 Claims, 6 Drawing Sheets

ELECTRICAL CONNECTOR HAVING POSITIONING POSTS

BACKGROUND OF THE INVENTION

1. Field of the Invention

The invention relates to an electrical connector, particularly to an electrical connector having positioning posts.

2. The Prior Art

A conventional electrical connector 10 having positioning posts 13 is shown in FIG. 1. The electrical connector 10 generally comprises an elongated insulating housing 11, two rows of passageways 12 for receiving conductive contacts, positioning means including two positioning posts 13 for positioning into a PCB (printed circuit board) 1 provided on both end portions of a surface of the housing 11, which surface is to be mounted to the PCB 1. Also referring now to FIG. 2, each of the positioning posts 13 is substantially circular and includes an open slot 15 extending through its center in the lengthwise direction of the housing 13 and a pair of positioning members 14 on both sides of the open slot 15. Each positioning member 14 is resilient and has an arcuate outer profile conforming to the side wall of a mating hole 2 of the PCB 1. When the connector 10 is mounted on the PCB 1 and the positioning posts 13 are inserted into the mating holes 2, the positioning members 14 will abut against the walls of the holes 2 for interferingly positioning the connector 10 relative to the PCB 1, and the opens 15 provide a space for elastic deformation of the positioning members 14.

Such positioning means, however, has the defect that the distance between the centers of the pair of positioning posts 13 (hereinafter referring to as "center distance of posts 13") should be precisely made to match the distance between the centers of a pair of mating holes 2 (hereinafter referring to as "center distance of holes 2") of the PCB 1, which increases the difficulty of manufacturing of the connector 10. In addition, this precisely matching requirement also makes it difficult to mount the connector 10 onto the PCB 1. Moreover, the positioning members 14 can be fractured due to over-deformation if an unmatch exists between the center distance of the posts 13 and the center distance of the holes 2. Furthermore, the open slots 15 are designed to be relatively wide to provide space enough for simultaneous inward elastic deformation of a pair of positioning members 14, while the positioning members 14 are designed to be relatively thin to provide resilient force enough to hold the connector 10 on the PCB 1 since the positioning posts 13 are fixed to the holes 2 by means of directly interfering fit therebetween, which seriously decreases the maximum deformation can be taken by the positioning members 14. As a result, a positioning member 14 is very likely fractured by over-deformation whenever only one said positioning member 14 is deformed due to an unmatch exists between the center distance of the posts 13 and the center distance of the holes 2.

Hence, there is a need for an electrical connector having positioning means that can overcome the above-mentioned defects.

SUMMARY OF THE INVENTION

Accordingly, one object of the present invention is to provide an electrical connector having positioning means which is easy to manufacture and to mount to a PCB.

Another object of the present invention is to provide an electrical connector having positioning means which has an excellent positioning effect.

Still another object of the present invention is to provide an electrical connector having positioning means which can prevent from mounting invertedly.

One more object of the present invention is to provide an electrical connector having reliable positioning means.

To fulfill the above-mentioned objects, according to one embodiment of the present invention, an electrical connector comprises an elongated insulating housing defining a lengthwise direction and a front surface to be mounted on a printed circuit; at least one row of passageways formed in the housing; a plurality of conductive contacts received in the at least one passageways; and a first and a second positioning posts formed on both lengthwise ends of the front surface for inserting into a pair of holes of the printed circuit board, wherein each of the first and second positioning posts defines a respective longitudinal direction, and includes a pair of positioning members on both longitudinal ends.

In one aspect, the electrical connector comprises a stop bar between the pair of positioning members, and an open slot between each of the positioning members and the stop bar; the width of the positioning post defined by both sides of the stop bar is shorter than the length of the positioning post defining between respective longitudinal outer surfaces of the positioning members.

These and additional objects, features, and advantages of the present invention will be apparent from a reading of the following detailed description of the embodiments of the invention taken in conjunction with the appended drawing figures, which are described briefly immediately below.

DETAILED DESCRIPTION OF THE PREFERRED EMBODIMENTS

Figure 1:
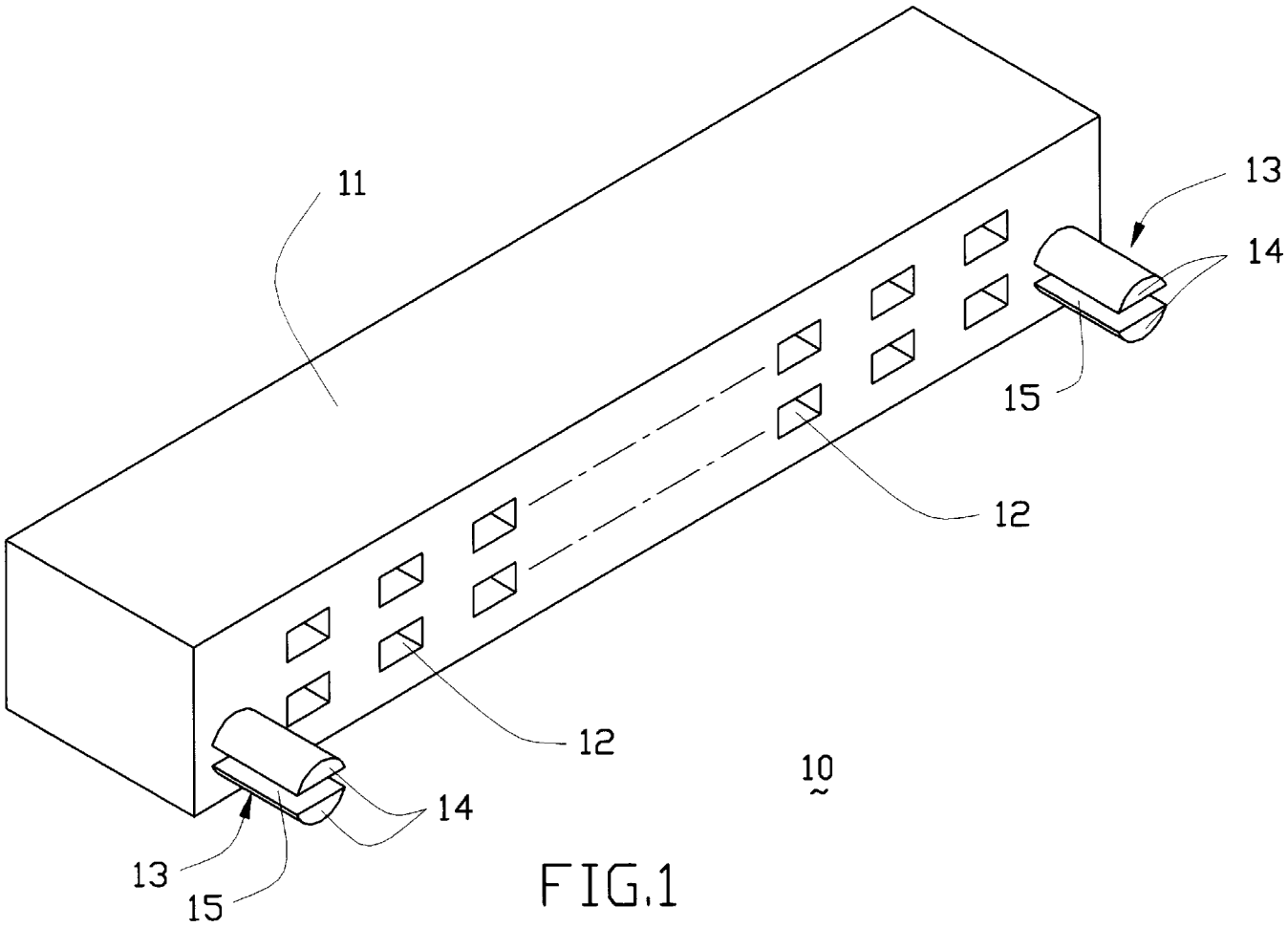
FIG.1 PRIOR ART
FIG. 1 is a perspective view of an electrical connector having conventional positioning means.
Figure 2:
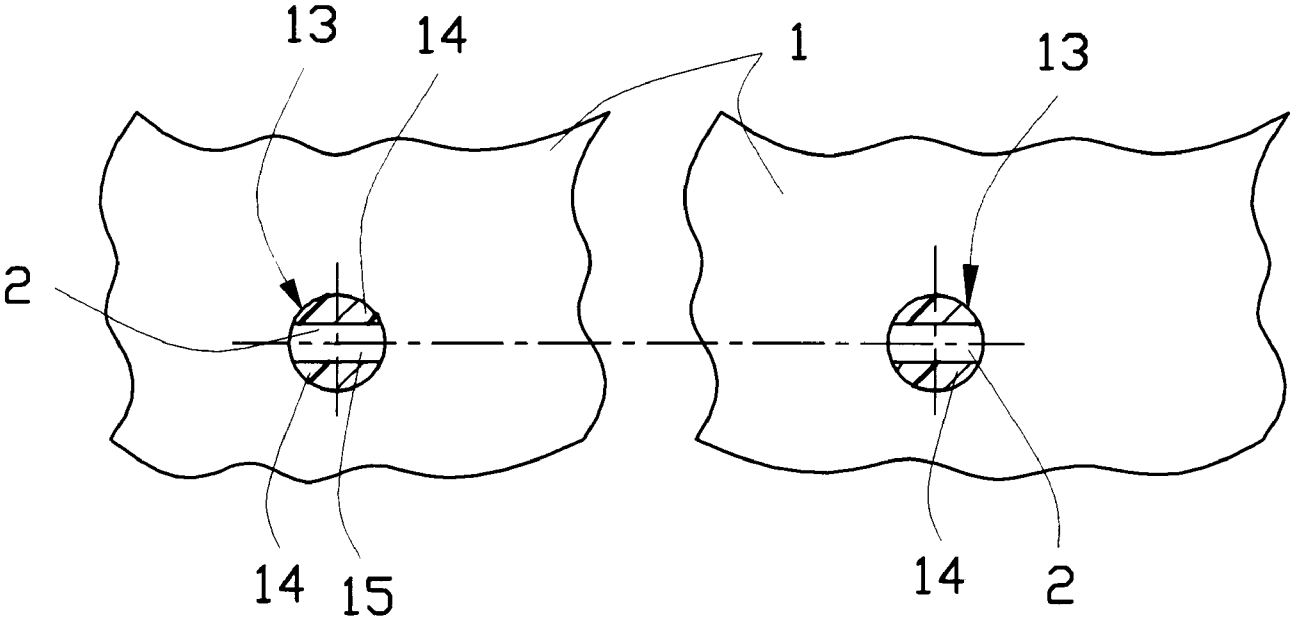
FIG.2 PRIOR ART
FIG. 2 is a partially cut-away cross sectional view of the electrical connector shown in FIG. 1, showing the mounting relation of the positioning posts to the mating holes of a PCB.

Reference will now be made in detail to the preferred embodiments of the present invention. It will be noted here that for a better understanding, most of like components are designated by like reference numerals throughout the various figures in the embodiments.

Figure 3:
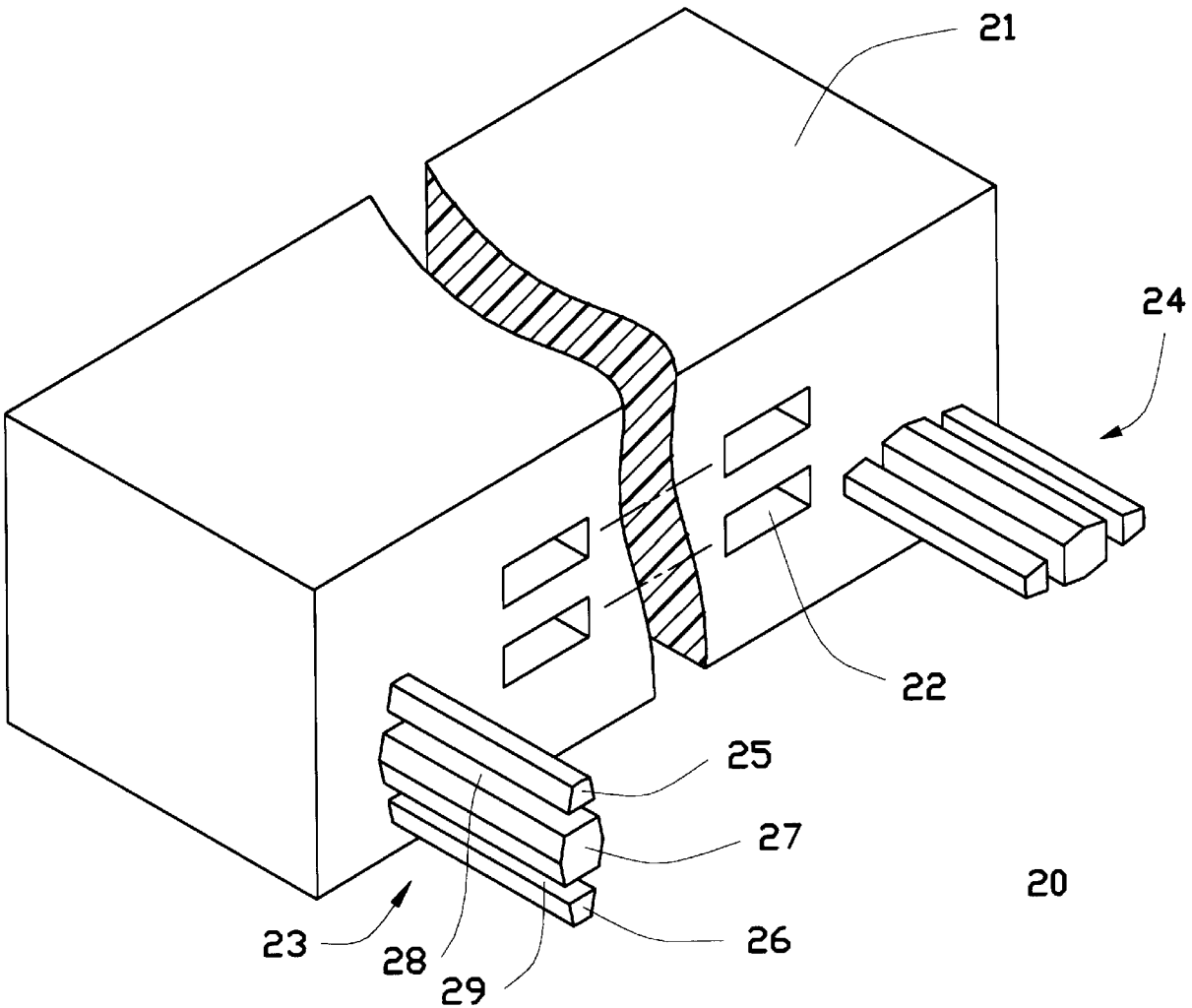
FIG. 3 is a perspective view of an electrical connector having positioning means according to one embodiment of the present invention.
Figure 4:
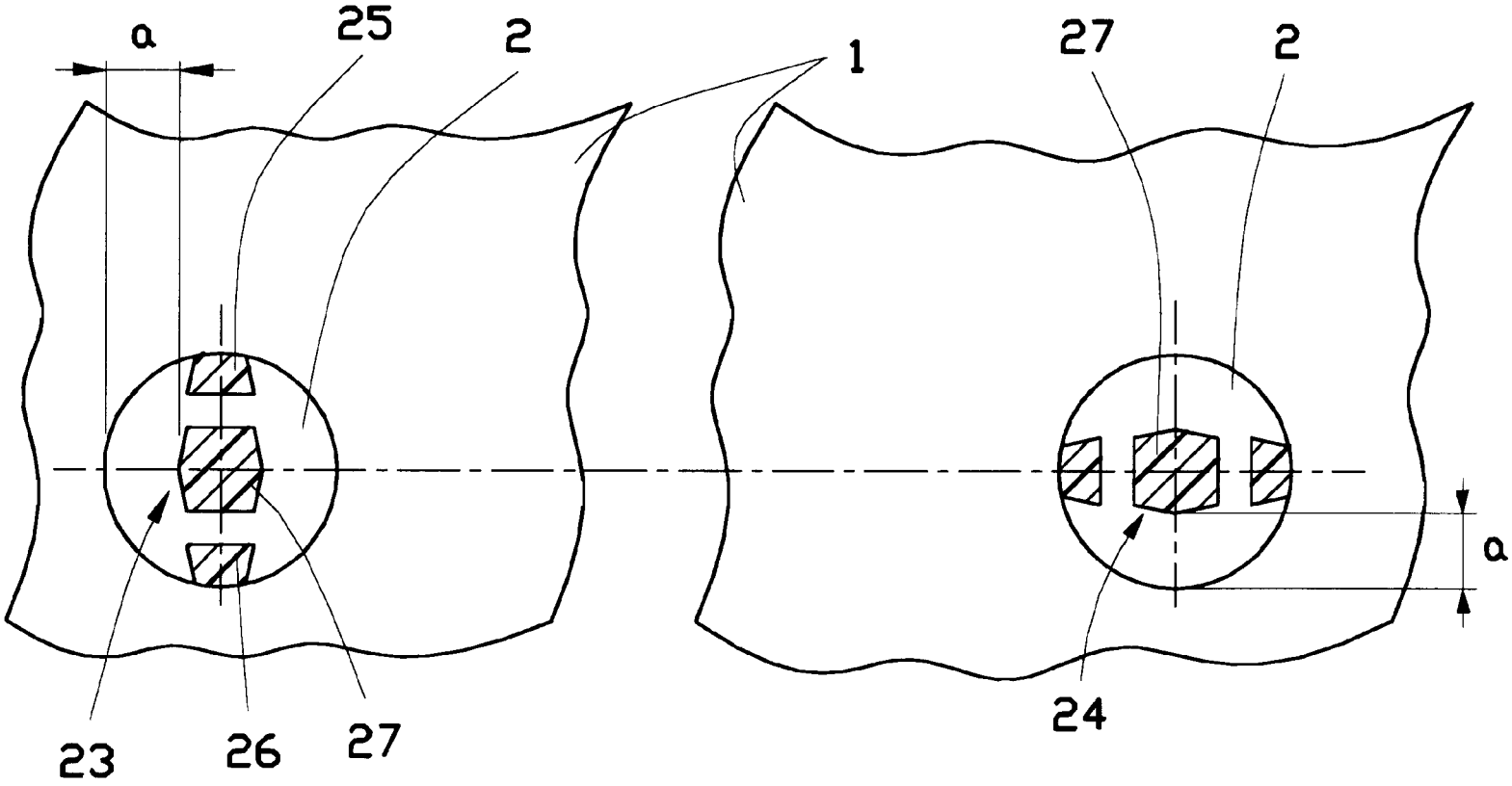
FIG. 4 shows a partially cut-away cross sectional view of the electrical connector shown in FIG. 3, showing the mounting relation of the positioning posts to the mating holes of a PCB.

Referring to FIGS. 3 and 4, an electrical connector having positioning means according to the present invention is generally designated at 20. The electrical connector 20 mainly comprises an elongated insulating housing 21 defining a lengthwise direction, a front surface to be mounted on a PCB (printed circuit board) 1 and a rear surface (not shown) to be engaged with a mating electrical element, such as a mating connector; at least one row of passageways 22 formed in the housing 21 for receiving conductive contacts therein, and a first and a second positioning post 23, 24 formed on two ends the front surface, respectively.

The first positioning post 23 has a generally diamond-shaped cross section defining a longitudinal direction extending in a transverse direction of the housing 21. The first positioning post 23 includes a first and a second positioning members 25, 26 on both longitudinal ends, a stop bar 27 between the pair of positioning members 25, 26, a transverse open slot 28 formed between the first position member 25 and the stop bar 27, and a transverse open slot 29 formed between the second position member 26 and the stop bar 27. In one embodiment, the outer face of each of the positioning members 25, 26 abutting the inner walls of the hole 2 is conformable to the inner wall; in other words, the radius of curvature of the outer face of each of the positioning members 25, 26 abutting the inner walls of the hole 2 is the same as that of the hole 2.

The second positioning post 24 has the same structure as the first positioning post 23, but defines a longitudinal direction parallel to the lengthwise direction of the housing 21. In other words, the orientation of the second positioning post 24 is perpendicular to that of the first positioning post 23.

When matching with a hole 2 of the PCB 1, the positioning post 23 abuts the walls of the mating hole 2 by its first and second positioning members 25, 26 with its lateral sides remaining a distance a away from the walls of the hole 2. Therefore, when mounting the connector 20 onto the PCB 1, a small amount of misalignment of the connector 20 relative to the hole 2 in the lengthwise direction of the housing 21 can be absorbed by the relative movement of the positioning members 25, 26 to their respective abutting walls since such relative movement will not incur large deformation to the positioning members 25, 26, and thus the positioning members 25, 26 of positioning post 23 can be completely inserted into the hole 2 without any difficulty. Similarly, the positioning post 24 also has a distance a between its positioning members and the walls of the hole 2 and thus can absorb a small amount of misalignment of the connector 20 relative to the hole 2 in the transverse direction of the housing 21, and thus the positioning members of positioning post 24 can be completely inserted into the hole 2 without any difficulty. As a result, misalignment of the positioning posts in both lengthwise and transverse directions of the housing 21 can be solved and the whole connector 20 can thus be completely and easily mounted onto the PCB 1, which facilitates mounting of the connector 20 onto the PCB 1.

When the positioning post 23 is mounted in the hole 2, the positioning members 25, 26 are inwardly pressed by the inner walls of the hole 2, and the resilient forces exerting on the inner walls by the positioning members 25, 26 provide retention forces for retaining the positioning post 23 on the PCB 1. As the positioning members 25, 26, are pressed inwardly, the open slots 28, 29 provide spaces for inward deformation of the positioning members 25, 26, respectively, and the stop bar 27 provides a support to the inwardly deformed positioning members 25, 26 for avoiding over-deformation thereof. Because the stop bar 27 does not receive any force due to its structure and location until the abutment of the positioning members 25, 26, it can provide excellent support effect to the positioning members 25, 26. The positioning post 24 including the same open slots for inward deformation of its positioning members and the same stop bar 27 for avoiding over-deformation thereof as the positioning post 23 does, is retained on the PCB 1 due to its positioning members. Therefore, the present connector 20 can be firmly retained on the PCB 1, and the problem of positioning post fracture due to over-deformation is also solved thereby.

It is appreciated to know that the existence of the open slots 28, 29 also provide more tolerance for misalignment of the positioning posts 23, 24 relative to holes 2 in both lengthwise and transverse directions of the housing 21. Understandably, the open slots 28, 29 of the positioning post 23 provide space for relative movement of positioning members 25, 26 to the hole 2 of the PCB 1. Therefore, each single one of the positioning posts 23, 24 provides alignment effect to holes 2 in both lengthwise and transverse directions of the housing 21. The orientation of the longitudinal directions of the positioning posts 23, 24, however, do not have to be vertical to and parallel to the lengthwise direction of the housing 21, respectively, for two reasons. First, the cooperation of the positioning posts 23, 24 can take up misalignment of the positioning posts 23, 24 relative to the holes 2 in two dimensions if only the longitudinal directions of the positioning posts 23, 24 are not parallel to each other and not collinear. Second, as mentioned above, with the help of the open slots 28, 29, each single one of the positioning posts 23, 24 can take up misalignment of the positioning posts 23, 24 relative to the holes 2 in two dimensions. Furthermore, the orientations of the longitudinal direction of each of the positioning posts 23, 24 do not have to be vertical to each other due to the two-dimensional self-alignment effect of each of them. The present invention can perform better if used in housing having standoff means provided on the lower surface thereof. In one embodiment, the sizes of the positioning post 23, 24 can be made differently to match holes 2 of different sizes to avoid mounting in an inverted orientation on a PCB.

Figure 5:
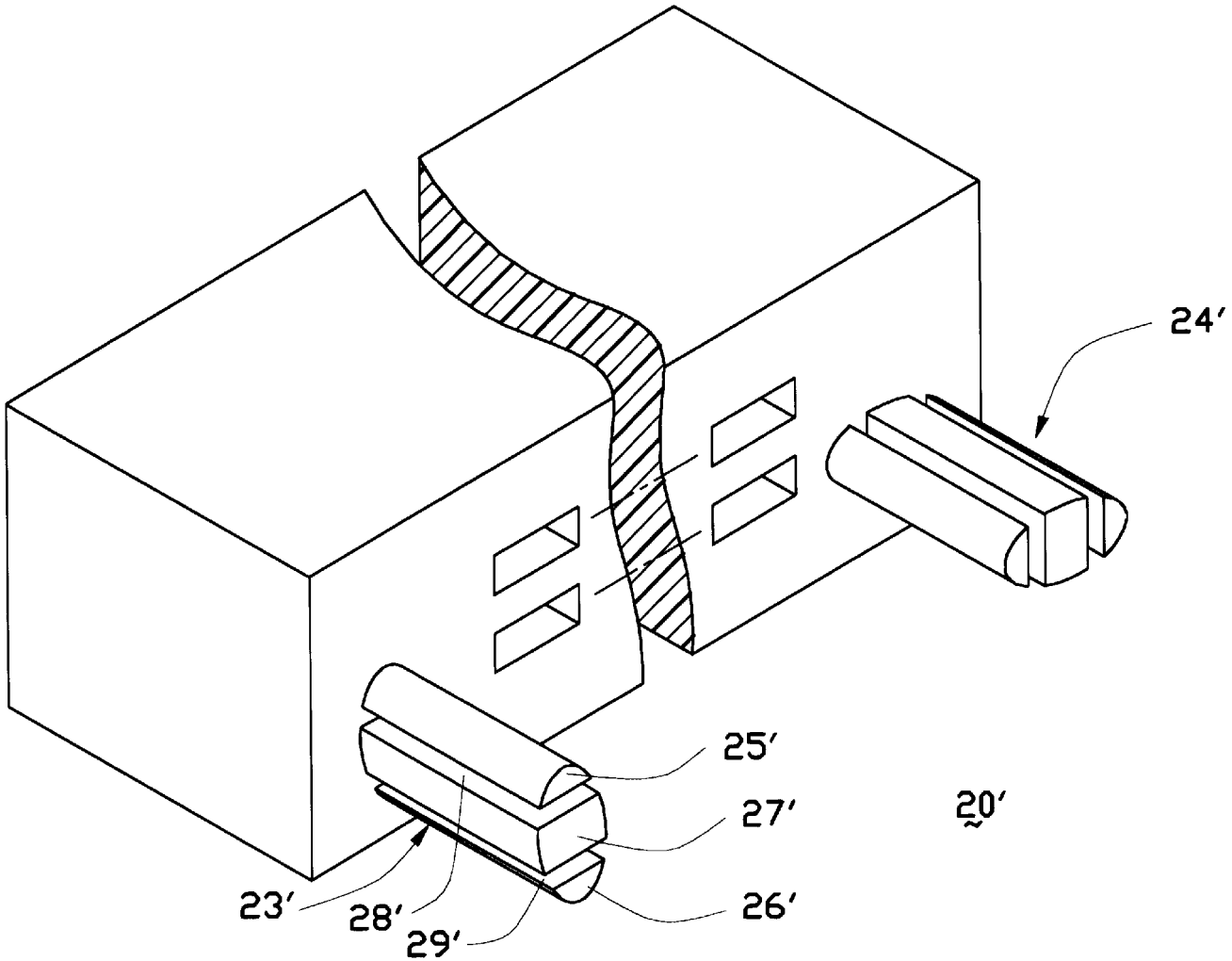
FIG. 5 is a perspective view of an electrical connector having positioning means according to another embodiment of the present invention.
Figure 6:
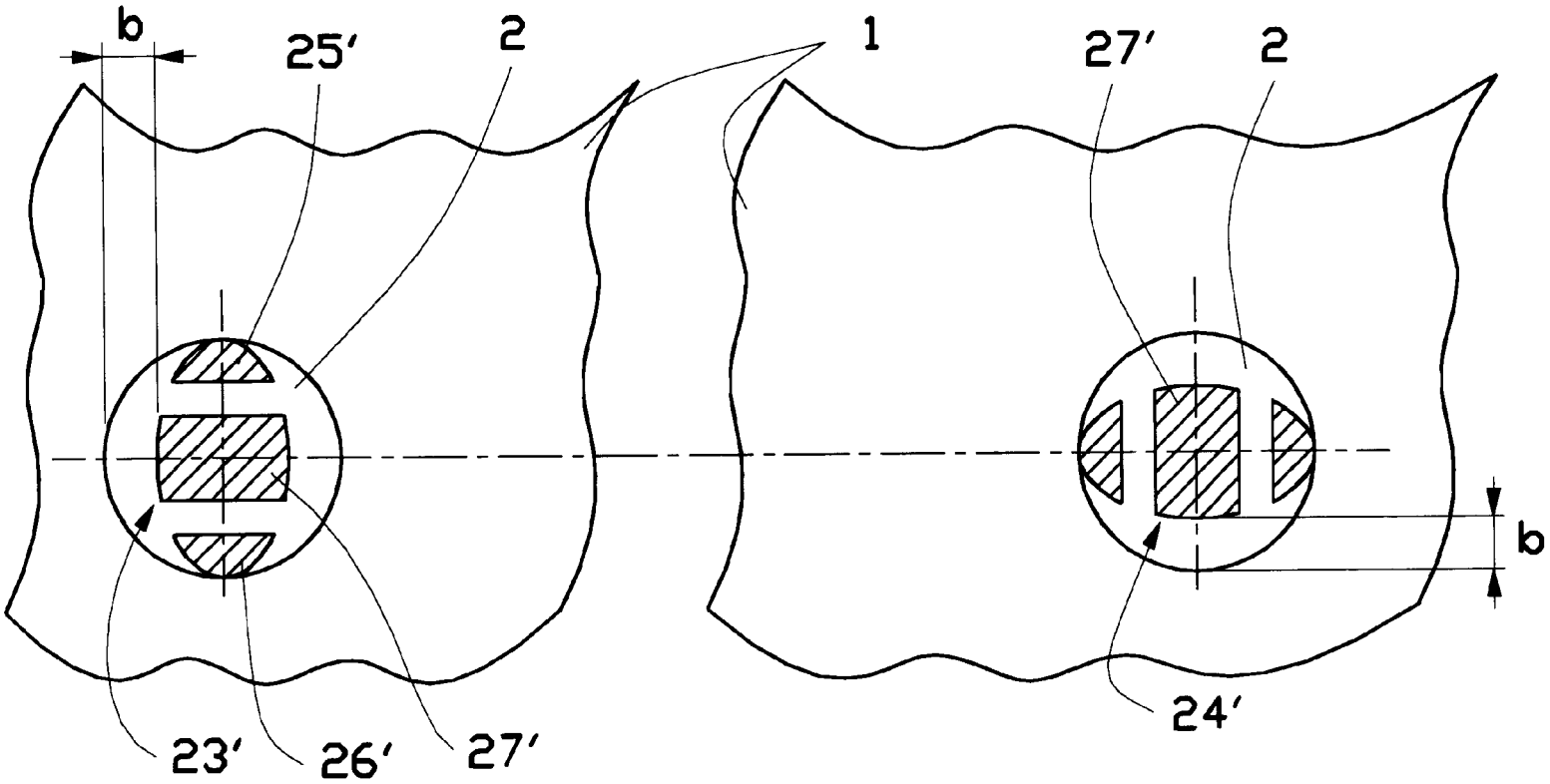
FIG. 6 shows a partially cut-away cross sectional view of the electrical connector shown in FIG. 5, showing the mounting relation of the positioning posts to the mating holes of a PCB.

FIGS. 5 and 6 show another embodiment of the electrical connector 20' having positioning means according to the present invention. The housing for the connector 20' is the same as that of the connector 20 shown in FIG. 3. The main difference of connector 20' from the connector 20 is that the generally cross sectional shape of the positioning posts 23', 24' is elliptical, rather than diamond-shaped. Each of the positioning posts 23', 24' includes a pair of positioning members 25', 26' on both ends of their longitudinal direction, a stop bar 27' between the pair of positioning members 25', 26', two transverse open slot 28', 29' formed between the position members 25', 26' and the stop bar 27', respectively. Due to the nature of an elliptical shape, the outer face of each of the positioning members 25', 26' abutting the inner walls of the hole 2 has a small radius of curvature than that of the hole 2, and remains a distance b between the lateral sides of the stop bar 27' and the walls of the hole 2. Such a smaller radius of curvature of the positioning members 25' or 26' makes it possess more tolerance for taking up misalignment of the positioning post 23' relative to holes 2 in lengthwise direction of the housing 21 than the positioning posts 23' does, since less deformation reaction will incur during relative movements of the positioning members 25', 26' to their respective abutting walls occur than that of the positioning members 25, 26.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

We claim:

1. An electrical connector, comprising:

an elongated insulating housing defining a lengthwise direction and a front surface to be mounted on a printed circuit board;

at least one row of passageways formed in the housing;

a plurality of conductive contacts received in the at least one row of passageways; and a first and a second positioning post formed on both lengthwise ends of the front surface of the housing for inserting into a pair of holes of the printed circuit board, each positioning post defining a longitudinal direction on the front face of the housing which is different from the other, wherein each of the first and second positioning posts includes a pair of positioning members and a stop bar between the positioning members, each positioning member and stop bar having a top end connected to the housing and a lower free end separated from the other.

2. The electrical connector as claimed in claim 1, wherein each positioning post has a width defined by said stop bar which is smaller than a length of the positioning post defined between the positioning members.

3. The electrical connector as claimed in claim 2, wherein each first and second positioning post has a generally diamond-shaped cross section.

4. The electrical connector as claimed in claim 2, wherein each first and second positioning post has a generally elliptical cross section.

5. The electrical connector as claimed in claim 2, wherein each first and second positioning post has a configuration similar to each other.

6. The electrical connector as claimed in claim 2, wherein said first and second positioning posts are of different sizes.

7. The electrical connector as claimed in claim 2, wherein said first and second positioning posts are integrally formed with the insulating housing.

8. The electrical connector as claimed in claim 2 including two rows of passageways aligning in the lengthwise direction of the housing and symmetrical to each other.

9. An arrangement of a pair of positioning posts on a first article for positioning said first article to a second article by extending the positioning posts into holes defined in the second article, each of the positioning posts defining a different longitudinal direction on the first article, and each of the positioning posts including:

a pair of positioning members extending from the first article to terminate at a free end;

a stop bar located between the positioning members and extending from the first article to terminate at a free end; and an open slot defined between each of the positioning members and the stop bar and extending to the free ends thereof; wherein each positioning post has a width defined by said stop bar which is less than a width of the positioning post defined between the positioning members thereof.

10. The arrangement as claimed in claim 9, wherein the longitudinal directions of the positioning posts are perpendicular to each other.

* * * * *